US007303169B2

(12) United States Patent
Hori et al.

(10) Patent No.: US 7,303,169 B2
(45) Date of Patent: Dec. 4, 2007

(54) RAIL GUIDED VEHICLE SYSTEM

(75) Inventors: Kikuo Hori, Kyoto (JP); Ken Nishimura, Neyagawa (JP); Motohiko Kuzuya, Aichi (JP); Toshiki Moriguchi, Nagaokakyo (JP)

(73) Assignee: Murata Kikai Kabushiki Kaisha, Kyoto-shi (JP)

( * ) Notice: Subject to any disclaimer, the term of this patent is extended or adjusted under 35 U.S.C. 154(b) by 0 days.

(21) Appl. No.: 11/008,183

(22) Filed: Dec. 10, 2004

(65) Prior Publication Data

US 2005/0150416 A1 Jul. 14, 2005

(30) Foreign Application Priority Data

Jan. 9, 2004 (JP) ..... 2004-004302

(51) Int. Cl.
*B61L 23/34* (2006.01)
*B61J 3/00* (2006.01)

(52) U.S. Cl. ..... 246/122 R; 104/88.02

(58) Field of Classification Search ..... 246/122 R, 246/124; 104/88.01, 88.02, 88.03, 88.04; 701/19

See application file for complete search history.

(56) References Cited

U.S. PATENT DOCUMENTS 4,766,547 A 8/1988 Modery et al.

FOREIGN PATENT DOCUMENTS

| | | | |
|---|---|---|---|
| EP | 0 721 872 | | 7/1996 |
| EP | 0 958 987 | | 11/1999 |
| JP | 63-073304 | * | 4/1988 |
| JP | 05-324064 | | 12/1993 |
| JP | 10-268937 | | 10/1998 |
| WO | WO 03/035427 | * | 5/2003 |

* cited by examiner

*Primary Examiner*—S. Joseph Morano
*Assistant Examiner*—Robert J. McCarry, Jr.
(74) *Attorney, Agent, or Firm*—Westerman, Hattori, Daniels & Adrian, LLP.

(57) ABSTRACT

An overhead running vehicle 10 uses an absolute position sensor or an encoder to detect its own position. The overhead running vehicle 10 then reports its own position and state to a system controller 14 via a communication line also used as an electricity feeding line. Further, the overhead running vehicle 10 intercepts reports from other overhead running vehicles 10 to avoid collisions or deadlocks. The system controller 14 and each overhead running vehicle 10 can determine the positions and state of other overhead running vehicles 10. This enables the system to be efficiently operated.

4 Claims, 4 Drawing Sheets

RAIL GUIDED VEHICLE SYSTEM

FIELD OF THE INVENTION

The present invention relates to a rail guided vehicle system for overhead running vehicles.

BACKGROUND OF THE INVENTION

The Unexamined Japanese Patent Application Publication (Tokkai-Hei) No. 10-268937 discloses a rail guided vehicle system having stations each provided with a bar code so that every time a rail guided vehicle passes by the station, its position is reported to a system controller. The inventors have further improved this patent by examining prevention of jamming, avoidance of deadlocks, and the like. The inventors have thus completed the present invention.

SUMMARY OF THE INVENTION

It is an object of the present invention to allow a rail guided vehicle system to be more efficiently operated. An additional object of the present invention relating to the aspect of the present invention in Claim 2 is to allow a rail guided vehicle to utilize reports to a system controller to determine the positions of other rail guided vehicles so as to run more efficiently. An additional object of the present invention relating to the aspect of the present invention in Claim 3 is to enable the avoidance of the collision between rail guided vehicles even with a short inter-vehicle distance.

In a rail guided vehicle system according to the present invention, a plurality of rail guided vehicles are each provided with means for recognizing a current position and means for communication with a system controller, and the system controller transmits a running instruction to each of the plurality of rail guided vehicles in accordance with the current positions and state of other rail guided vehicles.

Preferably, the plurality of rail guided vehicles are each provided with means for intercepting communication between each of the other rail guided vehicles and the system controller so as to control running of the rail guided vehicle on the basis of the positions of other rail guided vehicles obtained by the interception. At least the positions of other rail guided vehicles have only to be used from the signals intercepted. However, preferably, the running of the rail guided vehicle is controlled utilizing the positions and state of other rail guided vehicles.

Further, preferably, the running is controlled by determining an inter-vehicle distance from the positions of other rail guided vehicles obtained by the interception.

According to the present invention, the system controller can recognize both the current positions and state of the rail guided vehicles. The system controller can thus efficiently operate the rail guided vehicle system. It is possible to, for example, avoid deadlocks, prevent jamming, and preferentially deploys empty rail guided vehicles in an area in which many loading requests have been made.

According to the aspect of the present invention set forth in Claim 2, each rail guided vehicle can recognize the current positions of other rail guided vehicles on the basis of the intercepted communications between these rail guided vehicles and the system controller. This makes it possible to, for example, prevent collisions and avoid deadlocks.

According to the aspect of the present invention set forth in Claim 3, it is possible to determine the distance between the rail guided vehicle and the preceding one. Consequently, collisions can be prevented in spite of a short inter-vehicle distance or high-speed running.

DETAILED DESCRIPTION OF THE PREFERRED EMBODIMENTS

Figure 1:
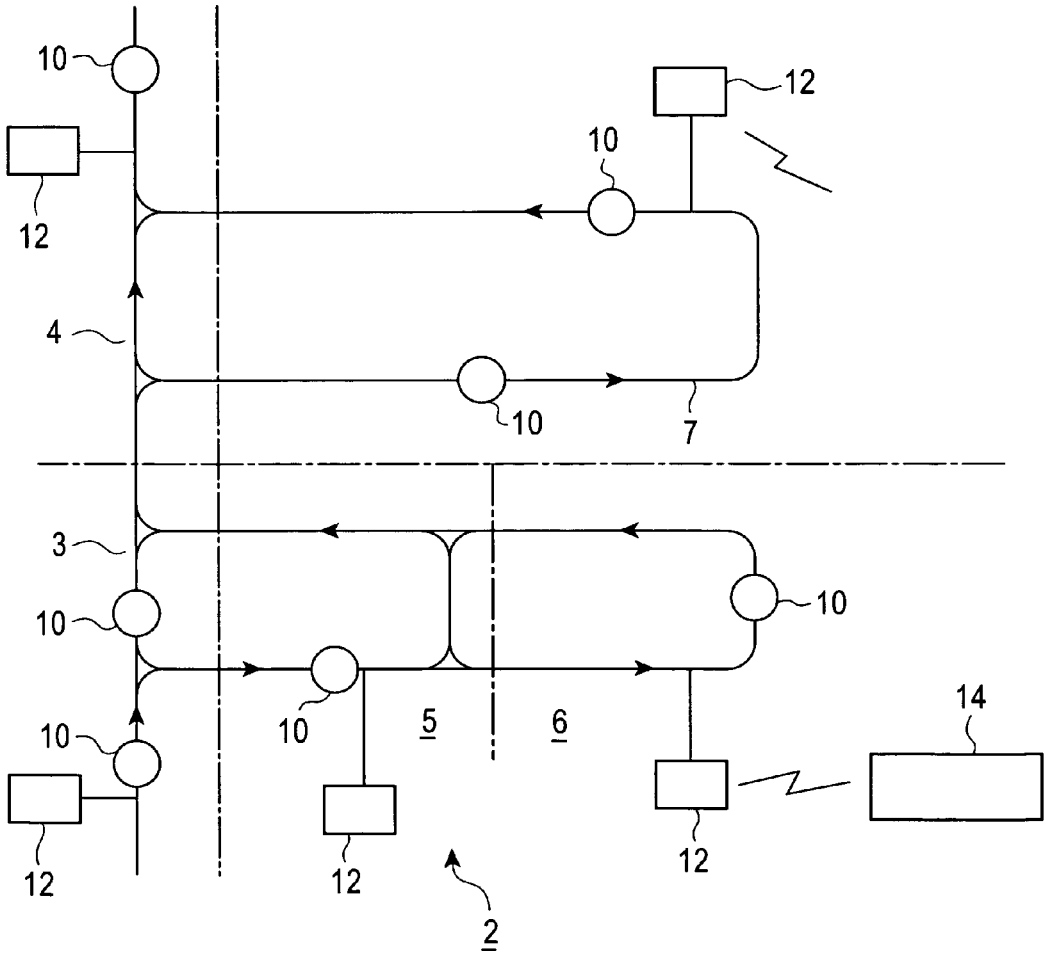
FIG. 1 is a diagram schematically showing the layout of an overhead running vehicle system according to an embodiment.

A preferred embodiment of the present invention will be described below.

FIGS. 1 to 6 show an embodiment of the present invention by taking an overhead running vehicle system 2 by way of example.

A running area for overhead running vehicles is divided into, for example, areas 3 to 7. In the overhead running vehicle system 2, a running rail and an electricity feeding rail (neither of them are shown in the drawings) are laid parallel to each other, for example, in a vertical direction. A power source (not shown in the drawings) supplies electricity to an electricity feeding line provided in the electricity feeding rail. Moreover, the electricity feeding line is connected to an area controller 12 so that overhead running vehicles 10 can communicate with the area controller 12 via the electricity feeding line. Each of the overhead running vehicles 10 has a pickup coil or the like in proximity to the electricity feeding line to transmit and receive signals to and from the electricity feeding line in a non-contact manner and at a predetermined frequency. For example, a current for the non-contact electricity feeding via the electricity feeding line is 10 KHz. A frequency for the communication with the area controller 12 is 200 KHz. When the frequency for electricity feeding and the frequency for communication differ by, for example, a factor of 10 or more, the same line can be used for both electricity feeding and communication. The electricity feeding line for the non-contact electricity feeding has a limited length and is thus laid out like a loop. The area controller 12 is provided for each area covered by one non-contact electricity feeding line. Further, a deadlock or the like is likely to occur in a branching or joining portion. Accordingly, one branching or joining portion is controlled by one area controller and is not distributed between two area controllers.

A large number of overhead running vehicles 10 are arranged along the overhead running vehicle system 2. In a large-scale system, 100 or more overhead running vehicles are arranged. The overhead running vehicle 10 runs along the running rail. The overhead running vehicle 10 is fed with electricity and make communications, via the electricity feeding line. In each area, the overhead running vehicle 10 communicates with the area controller 12 of that area to follow instructions from this area controller 12. Further, the overhead running vehicle 10 can wirelessly communicate with a system controller 14 directly or via the area controller 12. The wireless communication has only a small communication capacity and is thus used for predetermined communications such as transmission of a conveyance instruction from the system controller 14. The other communications are made via the communication line also used as the electricity feeding line. An exclusive communication line may be provided in the running rail for communications.

The area controller 12 transmits the position and state of each overhead running vehicle 10 received from it, to the system controller 14 via a LAN (not shown in the drawings). The area controller 12 transmits an instruction received from the system controller 14, to the overhead running vehicle 10 by wired communication or the like. The state of the overhead running vehicle 10 includes, for example, running, remaining stopped and standing by, remaining stopped owing to a blocked route, loading, unloading, low-speed running owing to a defect in a running motor, running in the opposite direction (for a special reason), and remaining stopped owing to a defect (movement disabled until restoration). Preferably, the area controller 12 also transmits information on the next destination (for example, a target station to which the overhead running vehicle 10 is to run or the next point through which the overhead running vehicle 10 is to pass).

Figure 2:
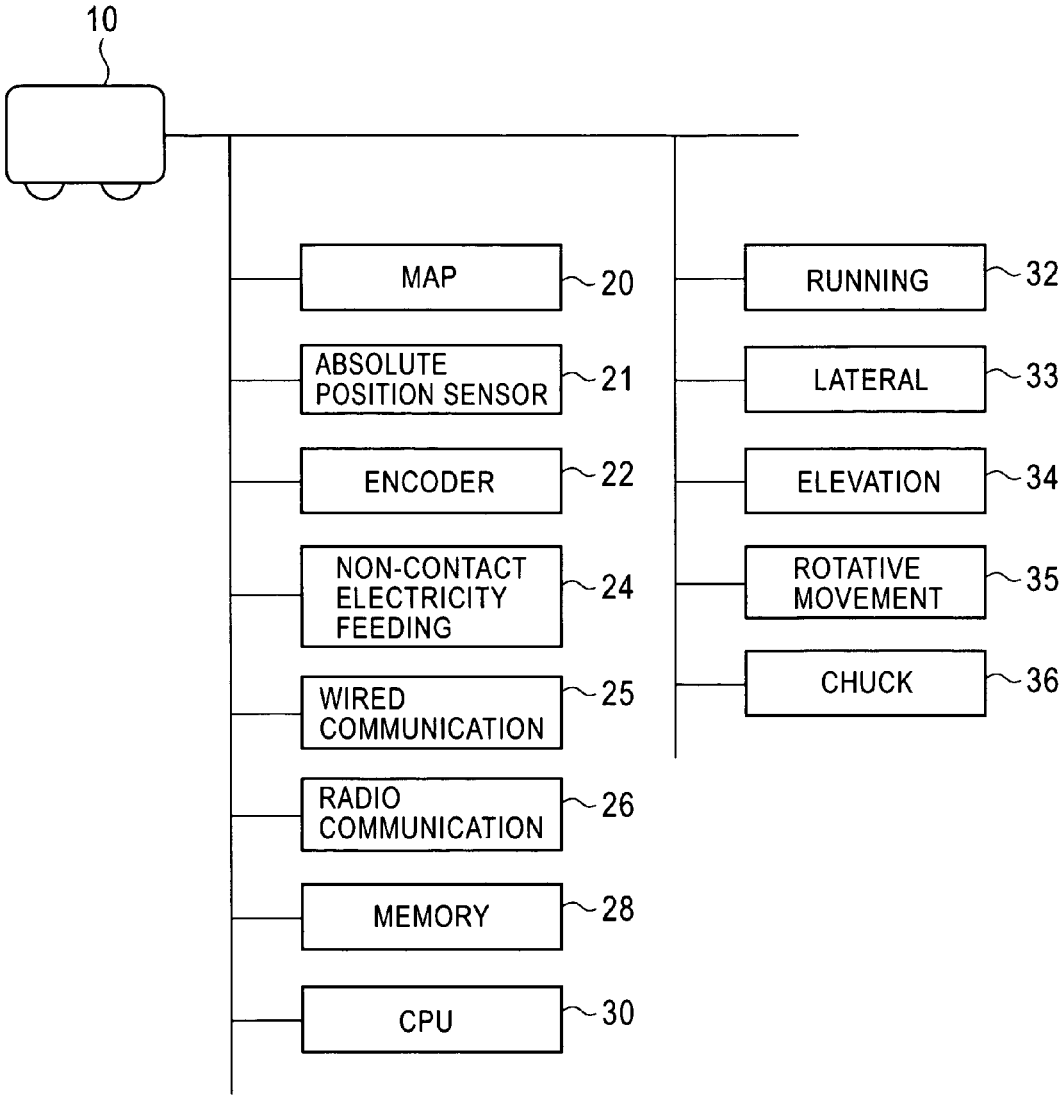
FIG. 2 is a block diagram of an overhead running vehicle used according to the embodiment.

FIG. 2 shows the configuration of the overhead running vehicle 10. A map 20 describes the layout of a running route, that is, the running rail, and the arrangement of stations along the running rail. The distance between stations can also be read from the map 20. Further, the positions and state of the other overhead running vehicles are written on the map 20 so as to avoid collisions and deadlocks. When the overhead running vehicles 10 report, to the system controller 14, their current positions and running destinations as well as their state such as conveying, unloading, or trouble (defect), each overhead running vehicle 10 can intercept these communications. The overhead running vehicle 10 then stores the current positions, state, and future running direction of the other overhead running vehicles 10 on the map 20.

The overhead running vehicle 10 knows its own absolute position. The overhead running vehicle 10 can thus determine the distance between itself and each of the other overhead running vehicles 10 on the basis of the map 20. The overhead running vehicle 10 can also determine the state of the preceding overhead running vehicle 10 (remaining stopped or running). Accordingly, the overhead running vehicle 10 can avoid collisions in spite of a short inter-vehicle distance or high-speed running. Since the overhead running vehicle 10 can determine the positions and state of other overhead running vehicles 10, it can avoid deadlocks and the like at its own discretion or on the basis of an instruction from the system controller 14. For example, in a branching, joining, or bypass portion, when the overhead running vehicle 10 determines the current position and next running destination of another overhead running vehicle 10 from the map 20, it can determine whether or not the second overhead running vehicle 10 may interfere with its running. The overhead running vehicle 10 can then determine whether or not a deadlock may occur.

An absolute position sensor 21 detects the absolute position (determined by an external sensor) of the overhead running vehicle 10 along the running route. The absolute position sensor 21 is, for example, a laser position sensor having a reflector provided at a predetermined position to detect the absolute position of the overhead running vehicle 10. Alternatively, marks may be provided at predetermined positions along the running route so as to be detected by the absolute position sensor 21. In this case, every time the overhead running vehicle 10 passes by any of the marks, its absolute position can be determined. An encoder 22 detects the rotation speed of a servo motor, running wheels, or the like of the overhead running vehicle 10. Thus, if the absolute position sensor 21 intermittently detects the absolute position, the position and speed of the overhead running vehicle 10 can be detected between detections of the absolute position.

The overhead running vehicle 10 comprises a non-contact electricity feeding section 24 and a wired communication section 25 along the electricity feeding rail. The non-contact electricity feeding is carried out at a frequency of about 10 KHz. The wired communication is made at a frequency of about 200 KHz. Accordingly, these operations can be simultaneously performed using the same line. A radio communication section 26 communicates with the system controller 14, the area controllers 12, and the like by feeder communication. The radio communication section 26 is not essential. Further, the overhead running vehicle 10 is provided with a general-purpose memory 28 and a CPU 30 to make various determinations and perform various types of control. A running driving section 32 drives running of the overhead running vehicle 10. A lateral drive 33 moves an elevation driving section 34 in a lateral direction of the running rail. The elevation driving section 34 and a rotative movement driving section 35 rotatively moves and elevates and lowers a chuck section 36 to transfer articles between the overhead running vehicle 10 and the appropriate station.

Figure 3:
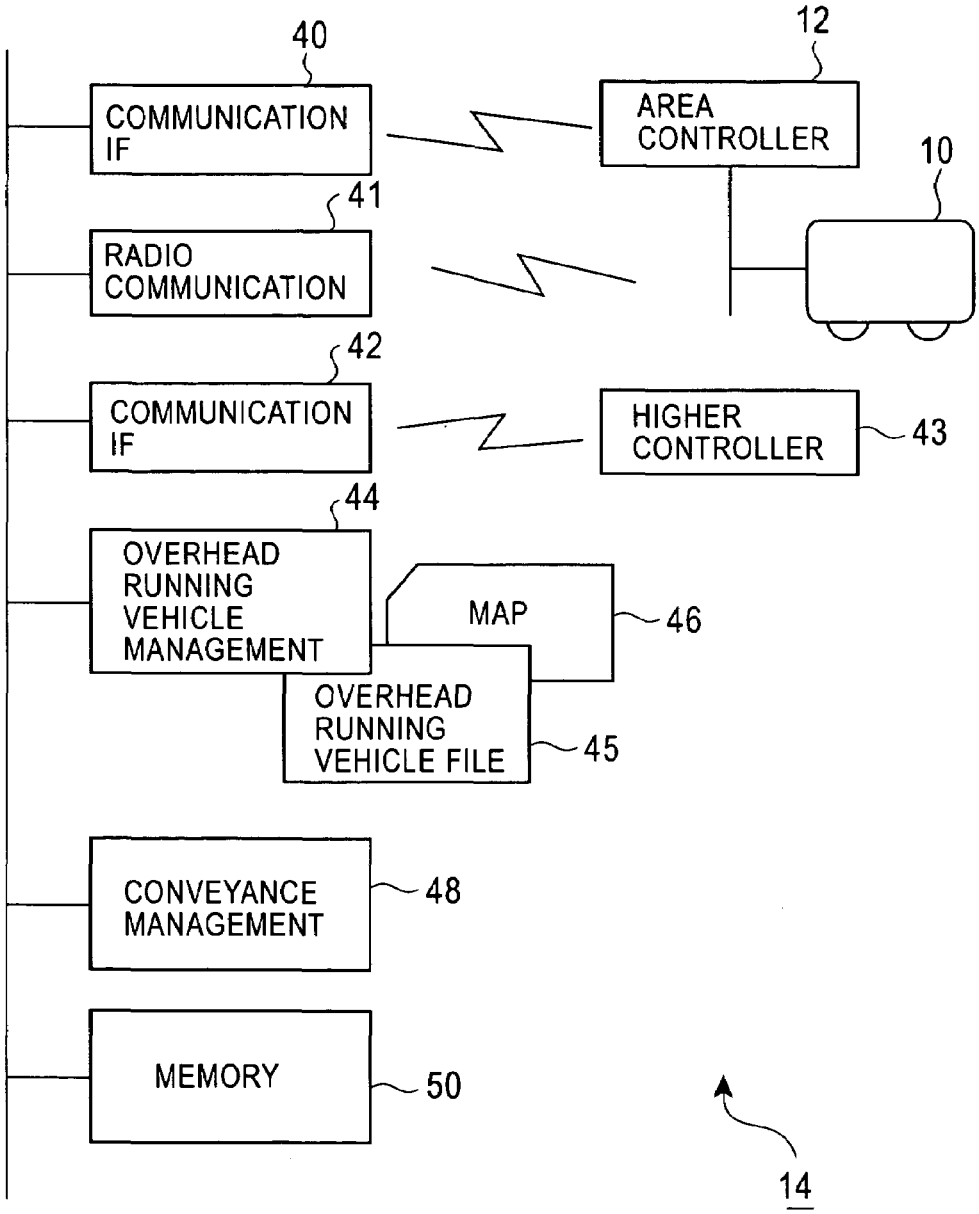
FIG. 3 is a block diagram of a system controller used according to the embodiment.

FIG. 3 shows the configuration of the system controller 14. A communication interface 40 communicates with the area controller 12 via a LAN such as Ethernet. The communication interface 40 receives the current positions and state of the overhead running vehicles 10 via the area controller 12. The communication interface 40 further gives a running and conveyance instructions to the overhead running vehicles 10. A radio communication section 41 communicates directly with the overhead running vehicles 10 without using the area controller 12. However, the radio communication section 41 often has a small communication capacity. Accordingly, the radio communication section 41 may fail to communicate appropriately in certain areas depending on, for example, the layout of a semiconductor processing facility. A communication interface 42 communicates with, for example, a higher controller 43 that controls both conveyance and production via a separate LAN. The communication interface 42 receives a conveyance request and reports the results of conveyance.

An overhead running vehicle managing section 44 manages the state and current positions of the overhead running vehicles 10. The overhead running vehicle managing section 44 stores the current positions and state of the overhead running vehicles 10 in, for example, an overhead running vehicle file 45. The positions and state of the overhead running vehicles 10 are also described in a map 46 so that the current positions and state can be managed using either the map 46 or the vehicle numbers of the overhead running vehicles 10. It is only necessary to provide one of the overhead running vehicle file 45 and map 46. The difference between the overhead running vehicle file 45 and the map 46 is that the overhead running vehicle file 45 allows retrievals based on the vehicle numbers or state of the overhead running vehicles 10, whereas the map 46 allows retrievals based on a position on the running route. A conveyance managing section 48 stores a file of conveyance requests received from the higher controller 43. The conveyance managing section 48 also stores a file of the results of conveyances such as executed conveyance requests, conveyance requests already assigned but being executed, and unassigned conveyance requests. 50 is a general-purpose memory.

Within one area, the overhead running vehicle 10 can determine the positions and state of other overhead running vehicles 10 by intercepting the communications between these overhead running vehicles 20 and the system controller 14. However, the overhead running vehicle 10 cannot determine the positions or state of the overhead running vehicles 10 in the other areas. Thus, the system controller 14 gives the overhead running vehicle 10 various instructions besides the conveyance instruction. However, within one area, each overhead running vehicle 10 can, for example, avoid deadlocks or collisions at its own discretion without relying on instructions from the system controller 14.

Figure 4:
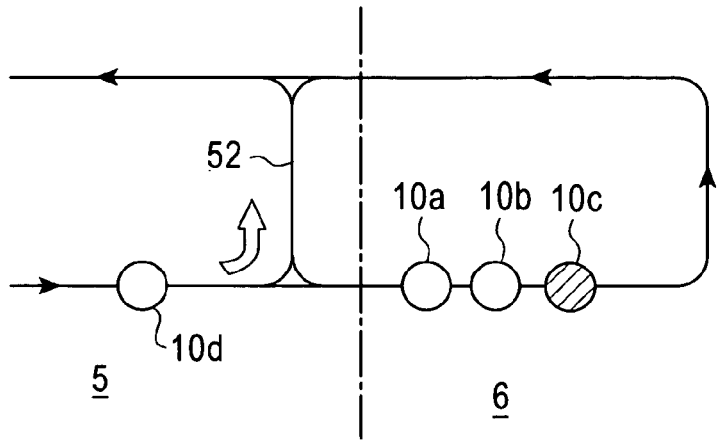
FIG. 4 is a diagram schematically showing how to avoid jamming according to the embodiment.

FIG. 4 shows how to prevent jamming. For example, the leading overhead running vehicle 10*c* in the area 6 is assumed to be unmovable owing to any trouble, with the succeeding overhead running vehicle 10*b*, 10*a* thus stopped. The system controller 14 knows not only that overhead running vehicles 10*a*~10*c* are in the area 6 but also that the overhead running vehicle 10*c* in trouble. Thus, the system controller 14 can instruct a succeeding overhead running controller 10*d* to run around the area 6 via a bypass 52. This serves to prevent the spread of jamming. The system controller 14 also knows that the overhead running vehicles 10*a*, 10*b* are operating normally as well as their current positions (particularly the positional order of the overhead running vehicles 10*a*, 10*b*). Consequently, the overhead running vehicles 10*a*, 10*b* can be backed in this order to escape from the bypass 52. If jamming is occurring in the area in which the overhead running vehicle 10 is running, it may change its running path without waiting for an instruction from the system controller 14, if possible, in order to avoid the jamming. However, in this case, the overhead running vehicle 10 having changed its running path reports the change to the system controller 14 via the area controller 12 or the like.

Figure 5:
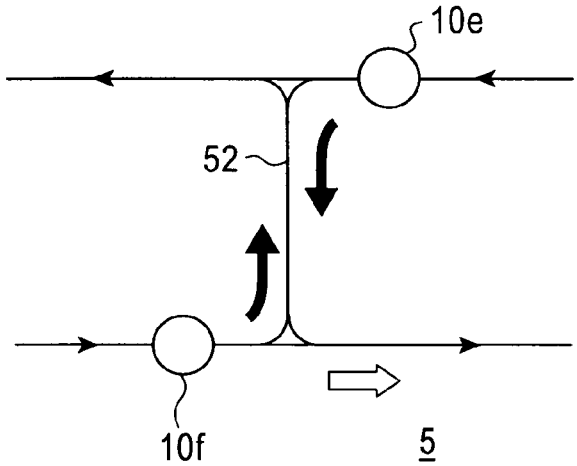
FIG. 5 is a diagram schematically showing how to avoid a deadlock according to the embodiment.

FIG. 5 schematically shows how to avoid a deadlock.

In this example, the overhead running vehicle 10*e* and the overhead running vehicle 10*f* are attempting to run along the bypass 52 in the opposite directions. In this case, provided that the bypass 52, and branching and joining portions located at the respective ends of the bypass 52 are arranged within the same area 5, the overhead running vehicle 10*e* can determine that a deadlock is likely to occur because the overhead running vehicle 10*f* is attempting to enter the bypass 52. Thus, for example, the system controller 14 is notified that the overhead running vehicle 10*e* attempting to run along the bypass 52 stopped to change its state to "remaining stopped". Then, the system controller 14 can instruct the overhead running vehicle 10*f* to enter the bypass 52. Alternatively, the overhead running vehicle 10*f* may intercept the communication between the overhead running vehicle 10*e* and the system controller 14 to enter the bypass 52, without waiting for an instruction from the system controller 14. This enables a possible deadlock to be easily avoided.

Figure 6:
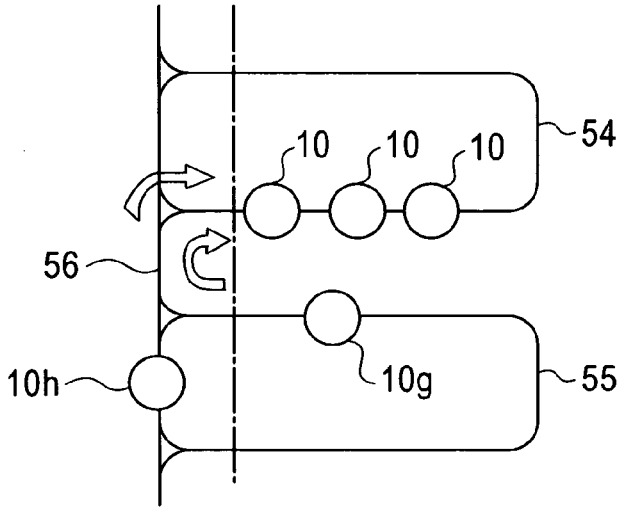
FIG. 6 is a diagram schematically showing how overhead running vehicles are collectively deployed in an area in which many loading requests have been made.

FIG. 6 shows an example in which many loading requests have been made in an area 54, so that the overhead running vehicles 10 need to be deployed in the area 54 as much as possible. The system controller 14 receives information on the area in which loading requests have been made, from the higher controller 43 as a conveyance request. Upon determining that empty overhead running vehicles 10*g*, 10*h* are in nearby areas 55, 56, the system controller instructs these overhead running vehicles 10*g*, 10*h* to move to the area 54. This enables to the overhead running vehicles 10 to be deployed in accordance with the loading requests.

The embodiment shows the overhead running vehicles 10 but the present invention is applicable to rail guided vehicles running on the ground. Further, a loading device may or may not be mounted on the vehicle.

The embodiment can produce the following effects.

(1) The overhead running vehicles can communicate with the system controller utilizing the electricity feeding line for non-contact electricity feeding. This makes it possible to significantly increase the communication capacity. Thus, not only the positions but also the state of the overhead running vehicles can be reported to the controller. Moreover, within the same area, each overhead running vehicle can intercept the communications of other overhead running vehicles.

(2) The system controller can determine the position and state of each overhead running vehicle. Further, each overhead running vehicle can determine the positions and state of other overhead running vehicles within the same area.

(3) Thus, the overhead running vehicle can run at high speed while avoiding collisions in spite of a reduced inter-vehicle distance. It is also possible to prevent jamming and deadlocks and to deploy a large number of empty overhead running vehicles in an area in which many loading requests have been made. Moreover, immediately close empty overhead running vehicles can be assigned to a conveyance instruction with a high priority. Further, the overhead running vehicle can accurately predict the time required by other overhead running vehicles for running on the basis of their positions and state. Moreover, the overhead running vehicle can select a route that it can run in the shortest time.

The invention claimed is:

1. A rail guided vehicle system comprising:

a plurality of rail guided vehicles, are each provided with means for recognizing a current position and means for communication with a system controller, and a running area for said plurality of rail guided vehicles, divided into a plurality of areas, wherein the system controller transmits a running instruction to each of the plurality of rail guided vehicles in accordance with the current positions and state of other rail guided vehicles, wherein the plurality of rail guided vehicles are each provided with means for intercepting communication between each of the other rail guided vehicles, and wherein when a jamming or deadlock is imminent, one rail guided vehicle from among the plurality of rail guided vehicles can control its own running on the basis of the position of other running vehicles, without waiting for said running instruction from said system controller, and wherein each of said plurality of areas is provided with an area controller which communicates with said plurality of rail guided vehicles and said system controller.

2. The rail guided vehicle system according to claim 1, wherein running is controlled by determining an inter-vehicle distance from the positions of the rail guided vehicles obtained by the interception.

3. The rail guided vehicle system according to claim 1, wherein said means for communication utilizes an electricity feeding line for non-contact electricity feeding.

4. The rail guided vehicle system according to claim 2, wherein said means for communication utilizes an electricity feeding line for non-contact electricity feeding.

* * * * *